US007591308B2

(12) United States Patent
Bender

(10) Patent No.: US 7,591,308 B2
(45) Date of Patent: Sep. 22, 2009

(54) MULTI GAS WELL PRODUCTION ARRANGEMENT

(75) Inventor: Robert E. Bender, Morrison, CO (US)

(73) Assignee: WellMaster Corp, Lakewood, CO (US)

( * ) Notice: Subject to any disclaimer, the term of this patent is extended or adjusted under 35 U.S.C. 154(b) by 78 days.

(21) Appl. No.: 11/784,771

(22) Filed: Apr. 9, 2007

(65) Prior Publication Data

US 2008/0029272 A1 Feb. 7, 2008

Related U.S. Application Data

(63) Continuation-in-part of application No. 11/715,216, filed on Mar. 7, 2007, and a continuation-in-part of application No. 11/350,367, filed on Feb. 8, 2006, now Pat. No. 7,395,865.

(60) Provisional application No. 60/790,848, filed on Apr. 10, 2006.

(51) Int. Cl.
*E21B 43/12* (2006.01)
*E21B 47/12* (2006.01)

(52) U.S. Cl. ..... 166/250.15; 166/68; 166/105.5; 166/267; 166/372

(58) Field of Classification Search ..... 73/152.29, 73/152.32, 152.58
See application file for complete search history.

(56) References Cited

U.S. PATENT DOCUMENTS 5,959,547 A * 9/1999 Tubel et al. ..... 340/853.2
2007/0175640 A1 * 8/2007 Atencio et al. ..... 166/369

* cited by examiner

*Primary Examiner*—Zakiya W. Bates
(74) *Attorney, Agent, or Firm*—Don Halgren

(57) ABSTRACT

A method of optimizing fluid (gas/oil) throughput of a battery complex to monitor and control the flow of an individual well in a field of wells at any particular instance in time and to allocate production of a specific well. The method comprises one or more of the steps of; providing a master control unit within the battery complex; placing an individual control unit on each of the individual wells in said field of wells; arranging a communications network between each of the individual control units at each well in the field and the master control unit in the battery complex; reporting each individual well's gas production factors to the master control unit; and sending a control signal to each individual well to control its production based upon the monitoring of the collective signals received by the master control unit from the field of individual wells.

33 Claims, 4 Drawing Sheets

54
72
74
74
54
26
14
22
52
54
60
54
54
54
54
70

MULTI GAS WELL PRODUCTION ARRANGEMENT

This application is based upon Provisional Patent application Ser. No. 60/790,848 filed Apr. 10, 2006, and is a continuation in part application of application Ser. No. 11/350,367 filed Feb. 8, 2006, now U.S. Pat. No. 7,395,865 and is a continuation in part of co-pending application Ser. No. 11/715,216, filed Mar. 7, 2007, each of which are incorporated herein by reference in its entirety.

BACKGROUND OF THE INVENTION

1. Field of the Invention

This invention relates to gas and oil wells and more particularly to control systems for maximizing the efficiency and output particularly of a group of gas wells with respect to a single centralized control and collection arrangement.

2. Prior Art

Natural gas is a relatively inexpensive, clean-burning fuel which has replaced coal and oil in many areas for the generation of electric power. It has become one of the basic fuel commodities in the United States. However, the prices of oil and gas has increased dramatically over the past few years. Industry has responded by drilling many more wells. Often, such wells are drilled in a particular geographic pattern so as to supply a centralized production facility served by a number of wells, which is far more economical than having each well with its own production facility.

It is thus an object of the present invention to overcome the disadvantages of the current production and collection of gas from a plurality of wells into a centralized separation, collection and measurement facility.

It is a further object of the present invention to provide a production facility arrangement which optimizes output of gas and oil from each well in a collection of wells in a production facility.

It is also an object of the, present invention to provide a means by which production "throughput" of the centralized facility may be maximized.

It is still a further object of the present invention to provide a means of controlling the production of a number of wells as well as monitoring the production from any particular well within that production facility, so as to optimize production of the highest producing wells and giving the lesser producing wells time to re-pressurize for optimum production therefrom.

It is a further object of the present invention to utilize a wireless plunger arrangement to signal respective individual well controllers about particular well conditions for "real-time" determination of optimum output by the system's central controller.

It is a further object of the present invention to provide a plunger location arrangement for tracking plunger location and "well-bottom timing" of the plungers in the various wells for optimizing well output and for insuring safety in plunger speed control.

BRIEF SUMMARY OF THE INVENTION

The present invention relates to an arrangement for optimizing and maximizing the output of gas from a collection of separated gas wells in a drilled field. The drilled field may include gas and oil, as well as production of small amounts of water. The invention includes the collection of drilled wells which may number anywhere from 1 to about 8 or 10, are all in electronic and fluid communication with a production facility, or "battery." The battery, or production facility, includes a separator, which feeds one or more tanks to hold the liquid, and a meter run, where the gas produced, is measured. Such a production facility is preferably within the middle of the field of drilled wells.

Gas and liquid that is produced from each well is transported through a pipeline to the separator at the production facility. The separator separates the gas from the liquid and further separates the liquid into its respective oil and water content. The gas in the separator leaves that separator and flows through the meter run, where it is measured. The gas then preferably flows into a sales pipeline and is then transported to market, a gas gatherer or holding tank. The oil leaves the separator via a separate pipe, and is deposited into an oil holding tank, which may be subsequently hauled off by a truck or through a feedline. Similarly, water may likewise be deposited in a separate holding tank for subsequent removal.

Each production well of the collection field is drilled into the earth's gas-producing formations from which the gas and liquid are retrieved. Each production well has a vertically displaceable plunger arranged within its vertically disposed well tubing. The plunger is pressurizably pushed to the top of the well tubing, whereupon a sensor at the wellhead records its arrival. Additional wellhead sensors read casing and tubing pressures, which along with the plunger sensor input, are relayed to an individual wellhead controller specific to each well in the group. Each particular well preferably has its own individual control unit thereon which opens and closes a motor valve in the flowline for that well. Control of the motor valve may be effected by a wired or wireless signal sent from the master controller The production facility or battery has a master controller thereat. Each individual control unit at each particular well is in communication with the master control at the battery or production facility via a landline, internet, or RF or like communication connection therebetween. The master control unit at the production facility or battery continuously monitors the field of wells and their respective control units. When any number of programmed parameters are met at any individual well, the master control unit will change that specific well's state from "closed" to "ready-to-open". Provided that there are no conflicts with any other well in the battery, the master control unit will instruct that well to open and thus begin its flow cycle. If a conflict exists such as another well already flowing or that more than one well is ready to open at a time, the master control unit will choose the well with the highest priority and cause it to go "open" and begin its flow cycle. The master control unit may monitor the supply of gas and liquid as the fluid itself is fed through the separator and the meter run from the particular currently producing well.

When a next available well is signaling the master controller from its own particular individual control unit, the master control will signal that next available well to begin production once the currently producing well is finished producing if it's priority is higher than the next well to open or upon its plunger arrival. Therefore, if the currently producing well is of lower priority than the next available well to open, the master control unit will close the currently producing well on plunger arrival or at any point during its afterflow cycle and cause the higher priority well to open. The constant monitoring by the master control unit of all of the wells within its particular field thus monitors and optimizes each well's output to the separator as well as determines which well is producing what quantity of gas, oil and water. This is significant in certain situations, because each particular well may have different interest owners and/or royalty interest owners from the other wells in the field.

Each particular well may be controlled by its own individual unit controller and being powered by, for example, a solar panel, and motor valves, which are ultimately controlled by the master control unit at the battery. Any particular well may be closed for a period of time, to permit pressure to build up therein, after which that wellhead will be open to flow, bringing that plunger and its liquid load to the surface. During such a flow, the particular well may have a high rate of output because of its optimized procedures. By controlling each individual well's flow into the separator, the volume of the gas and liquid may be easily handled, instead of being overwhelmed if all wells were to flow at their own particular flow rate. A strong well and a weak well, if allowed to flow simultaneously, would be detrimental to the weak well, where that weaker well may load up with fluid because its plunger could not make it to the surface to deliver its liquid load. In such a case, the weaker well may not be able to flow at all due to a higher pressure exerted by the stronger well impeding the flow from the weaker well.

Such plungers themselves, may have sensors therein, to provide an rf, sonic or b-field/wireless data feed to the local control units at each particular well. Such control unit at each wellhead is responsible for turning the well on and off, and reporting the casing and tubing pressure of the well as well as plunger arrival. When a well is ready to come online and begin producing, either as a function of time or a function of pressure, the master controller at the production facility would permit it to do so, via a return rf signal. Once the local control unit is turned on at a particular well, that well would continue to produce until its particular plunger rose to the surface. Once the plunger surfaces, the controller of that unit goes into an "after flow" cycle. Once in this after flow cycle, a well of higher priority would be allowed to come on if it is inits ready state, and override the remaining flow of this particular diminishing weaker well. The master controller at the separator in the production facility would signal the weaker well to close and signal the stronger well to come online.

The master controller at the separator therefore works at optimizing the throughput of the separator and its fed meter run.

Each well's production in the producing field is logged against its actual flow, and the priority may be established. The highest producing well of the collection would have the highest priority. The master control unit at the production facility or battery is programmed to assess what the priority should be according to the production on an operator programmed interval from typically every several hours, to perhaps, once a week. This permits the priority of the wells to change as producing characteristics of individual wells have changed. This also permits further optimization of individual wells by their respective local control units. The master control at the production facility constantly calculates and analyzes production volume from each particular well. If the flow rate of a particular producing well falls below a calculated average, and another well is ready to open, then the currently producing well will be signaled to close upon plunger arrival regardless of its programmed afterflow time, and the new well will be signaled to be open. If there are no wells ready to be open, the currently producing well will be permitted to flow even though it is below the average for the production facility, until its after-flow time expires, its close pressure parameter is reached, or another well is ready to open.

The invention thus comprises a method of optimizing fluid (gas/oil) throughput of a battery complex to monitor and control the flow of an individual well in a field of wells at any particular instance in time and to allocate production of a specific well, comprising the steps of providing a master control unit within the battery complex; placing an individual control unit on each of the individual wells in the field of wells; arranging a communications network between each of the individual control units at each well in the field and the master control unit in the battery complex; reporting each individual well's gas production factors to the master control unit; and sending a control signal to each individual well to control its production based upon the monitoring of the collective signals received by the master control unit from the field of individual wells. The method may include selecting one of the wells from the collection of wells to begin production. The method may include providing data on output and selected factors of each well in the field. The method may include shutting down production of a first well once the master control unit has determined a superior production may be generated by another well. The method may include the step of initiating production from another well after the first well has been shut down by instruction signaled from the master control unit to the individual control unit on the first well. The method may include sending signals from a plunger in an individual well to the individual control unit at the individual well. The method may include the step of providing a well tubing traveling plunger in at least one of the wells in the field of wells; and monitoring the location of the plunger in the well containing the plunger. The method may include the step of controlling movement of the plunger in the well containing the plunger. The method may include the step of tracking the plunger when the plunger is at any point in the wells vertical length or is at the bottom of a well, to factor in such "mid-point" or "bottom"-locations relative to time into the "well-control" functions. The method may include the step of sending signals received from the plunger in an individual well by the individual control unit thereat, to the master control unit in the battery complex for monitoring and control of the well's production.

The invention also includes a method of optimizing fluid (gas/oil) throughput of a battery complex to monitor and control the flow of an individual well in a field of wells at any particular instance in time and to allocate production of a specific well, comprising one or more of the steps of: monitoring continuously a plurality of wellhead control units in a well field; evaluating input data received wirelessly from each of the wellhead control units; selecting a priority well for a production run in a series of production runs; and recording volume flow of each successive well's production.

The invention also includes an fluid (gas/oil) battery complex to monitor and control the flow of an individual well in a field of wells at any particular instance in time and to allocate production of a specific well, comprising a plurality of gas wells in a production field, a local control unit at each of the wells in the field, a master control unit in the battery complex in communication with the local control unit at each of the wells in the field to monitor, control and report upon each individual well's gas production; and a separator to separate gas from other fluids produced from the wells. The fluid (gas/oil) battery complex may include a wireless plunger sensor arrangement in each of the wells to provide individual well data to the local control unit for that particular well. The fluid battery complex may include a wireless plunger to report data on its own well and the master control unit accumulates date from all of the well's wireless plungers to provide instantaneous optimization of a fields output and the wells identifying data.

The invention also includes the battery complex wherein the plunger has an alarm mechanism therewith to send an alert signal to the well's individual control unit that the plunger is at the bottom of the well. The alarm mechanism on the plunger nay be an acoustic alarm mechanism. The individual control unit at the wellhead is preferably arranged to monitor and control velocity of the plunger in the well. The plunger preferably has pressure and fluid condition sensors therein to signal the individual control unit on the wellhead relative to the well's production characteristics. The alarm mechanism may comprise different acoustic signals at different locations within the well. The well's individual control unit may be comprised of an acoustic sensor arranged at a wellhead of the well in the field so as to pick up and report upon the plunger's real-time location.

The invention also includes a method of optimizing fluid (gas/oil) throughput of a battery complex to monitor and control the flow of an individual well in a field of wells at any particular instance in time and to allocate production of a specific well, comprising one or more of the steps of: monitoring continuously a plurality of acoustic signal-receiving wellhead control units in a well field, evaluating acoustically generated input data received from each of the acoustic signal-receiving wellhead control units by a master control unit, selecting a priority well for a production run in a series of production runs by the master control unit, recording volume flow of each successive well's production by the master control unit, arranging an acoustic signal generating means in a bottom location of said wells, arranging a signal generating means in a plurality of spaced apart locations along the depth of the wells.

The invention also comprises a fluid (gas/oil) battery complex to monitor and control the flow of an individual well in a field of wells at any particular instance in time and to allocate production of a specific well, comprising: a plurality of gas wells in a production field; a local control unit for each of the wells in the field; a movable plunger arranged within tubing in at least one of the wells whose movement is arranged to generate a signal regarding said plungers location in the tubing at a particular time, to its respective local control unit; a master control unit in the battery complex in communication with the local control unit at each of the wells in the field to monitor the plunger, and to thereby control and report upon each individual well's gas production; and a separator to separate gas from other fluids produced from the wells. The signal generated by movement of the plunger may be an acoustic signal. The signal generated by movement of the plunger may be an electromagnetic signal. The signal generated by movement of the plunger may be transmitted to the local control unit by a signal receiver/transmitter arranged on the tubing.

The invention also comprises a method of optimizing fluid (gas/oil) throughput of a battery complex to monitor and control the flow of an individual well in a field of wells at any particular instance in time and to allocate production of a specific well, comprising one or more of the steps of: monitoring continuously a plurality of signal-receiving wellhead control units in a well field; evaluating generated input data received from each of the signal-receiving wellhead control units by a master control unit; selecting a priority well for a production run in a series of production runs by the master control unit; and recording volume flow of each successive well's production by the master control unit.

The method includes one or more of the following steps: moving a plunger arrangement through a well's tubing, so as to generate a "well-condition" signal by virtue of said plunger's movement in said tubing, relative to a signal receiver/transmitter on said well's tubing. The "well-condition" signal may be an acoustic signal. The "well-condition" signal may be an electromagnetic signal. The plunger arrangement may have an electromagnetic field generator therein. The tubing may have an electromagnetic field generator thereon. The plunger arrangement may comprises a first upper plunger and a second lower plunger movable through the tubing. The upper plunger and the lower plunger may each emit well-condition reports on respective upper and lower portions of the well.

BRIEF DESCRIPTION OF THE DRAWINGS

The objects and advantages of the current invention will become more apparent, when viewed in conjunction with the following drawings, in which.

DETAILED DESCRIPTION OF THE PREFERRED EMBODIMENTS

Figure 1:
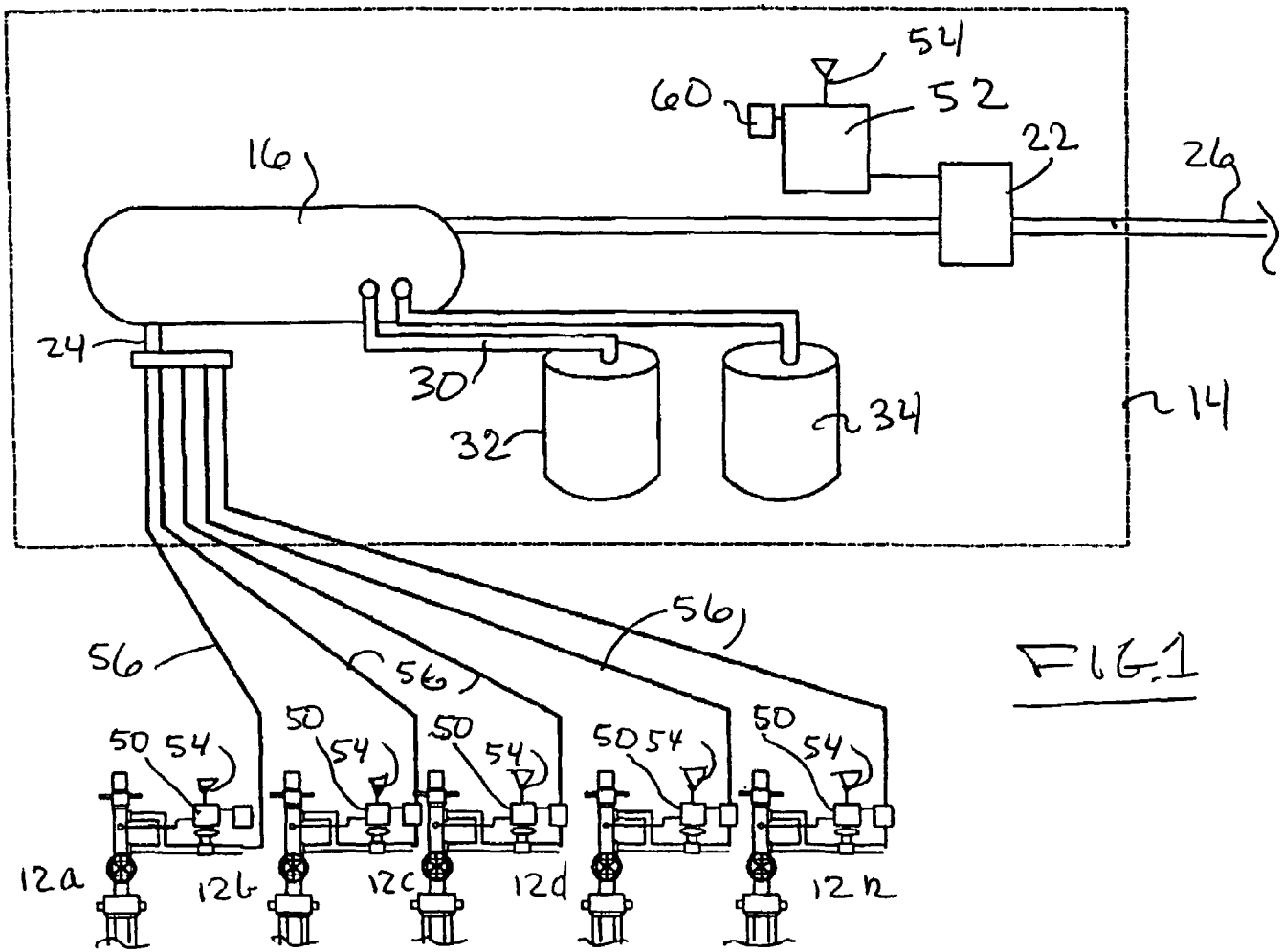
FIG. 1 is a schematic representation of a production facility, or battery, supplied by a plurality of adjacent wells in communication therewith.

The present invention relates to a gas production arrangement 10 for optimizing and maximizing the output of gas from a collection of separated gas wells 12*a*-12*n* in a drilled field, as represented by FIG. 1. The drilled field production may include gas and oil, as well as production of small amounts of water. The invention includes the collection of drilled wells 12*a*-12*n* which may number anywhere from 1 to about 8 or 10, which may all be in electronic, acoustic, optical (lightwave) and/or fluid communication with a production facility, or "battery" 14, as represented in FIG. 1.

The battery, or production facility 14, includes a separator 16, which may feed one or more tanks 18 and 20 to hold the liquid, and a meter run 22, where the gas produced, is measured for each individual well 12*a*-12*n*. However, upon leaving the separator and meter run 22 which is co-located with the master control unit 52, the gas may then proceed into a sales line 26 to an off location site. Such a production facility is preferably within the middle of the field of drilled wells or along a service road.

Gas and liquid that is produced from each well 12*a*-12*n* is transported through a pipeline 24 to the separator at the production facility 14. The separator 16 separates the gas from the liquid and further separates the liquid into its respective oil and water content. The gas in the separator 16 leaves that separator 16 and flows through the meter run 22, where it is measured and then gas is fed to the sales pipeline 26, as represented in FIG. 1. The oil leaves the separator 16 via a separate pipe 30, and is deposited into a oil holding tank 32, which may be subsequently hauled off by a truck or through a feedline. Similarly, water may likely be deposited in a separate holding tank 34 for subsequent removal.

Figure 2:
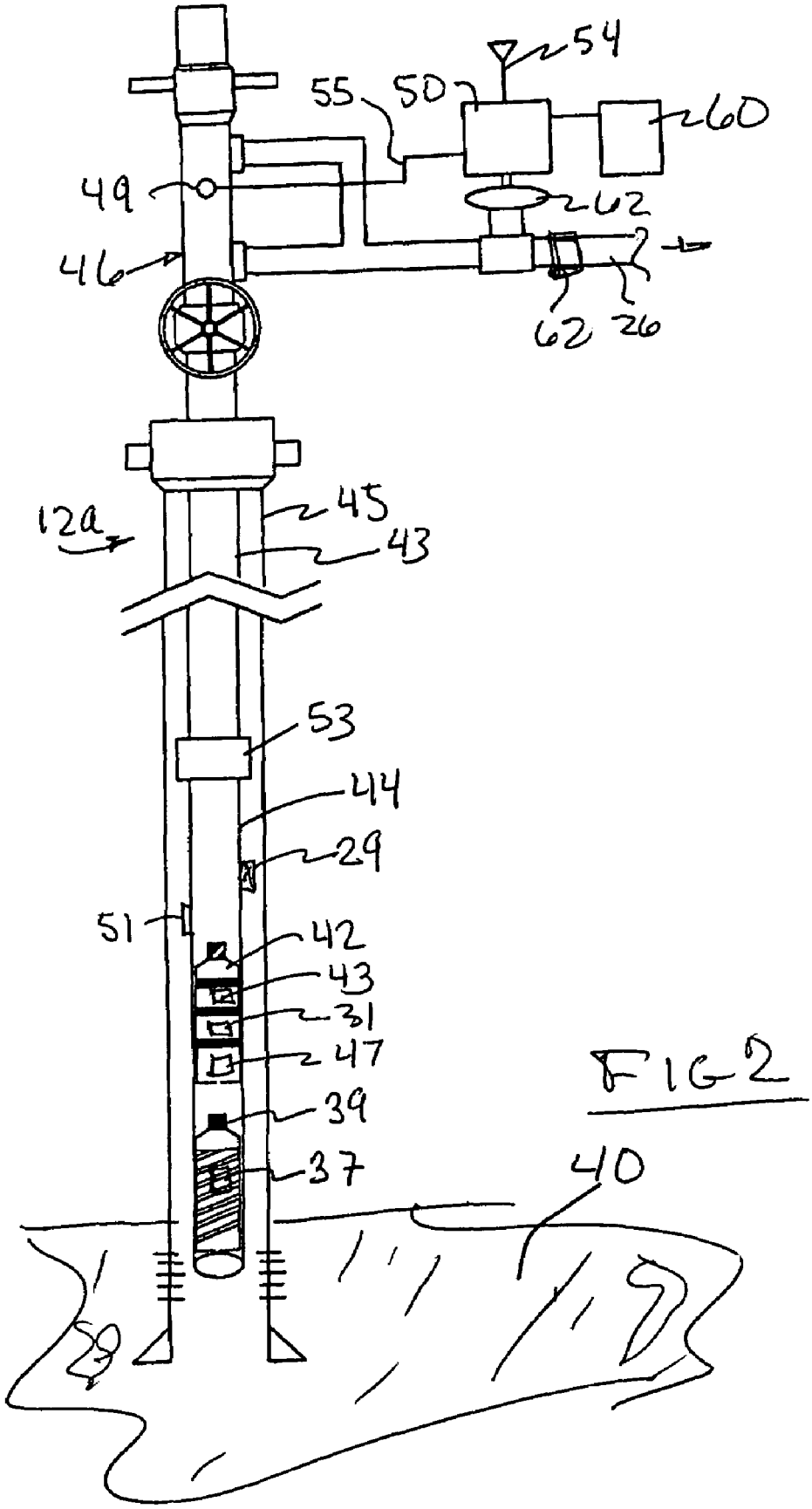
FIG. 2 is a side elevational view of an individual well showing the components thereof, and particularly with a single plunger therewith.
Figure 3:
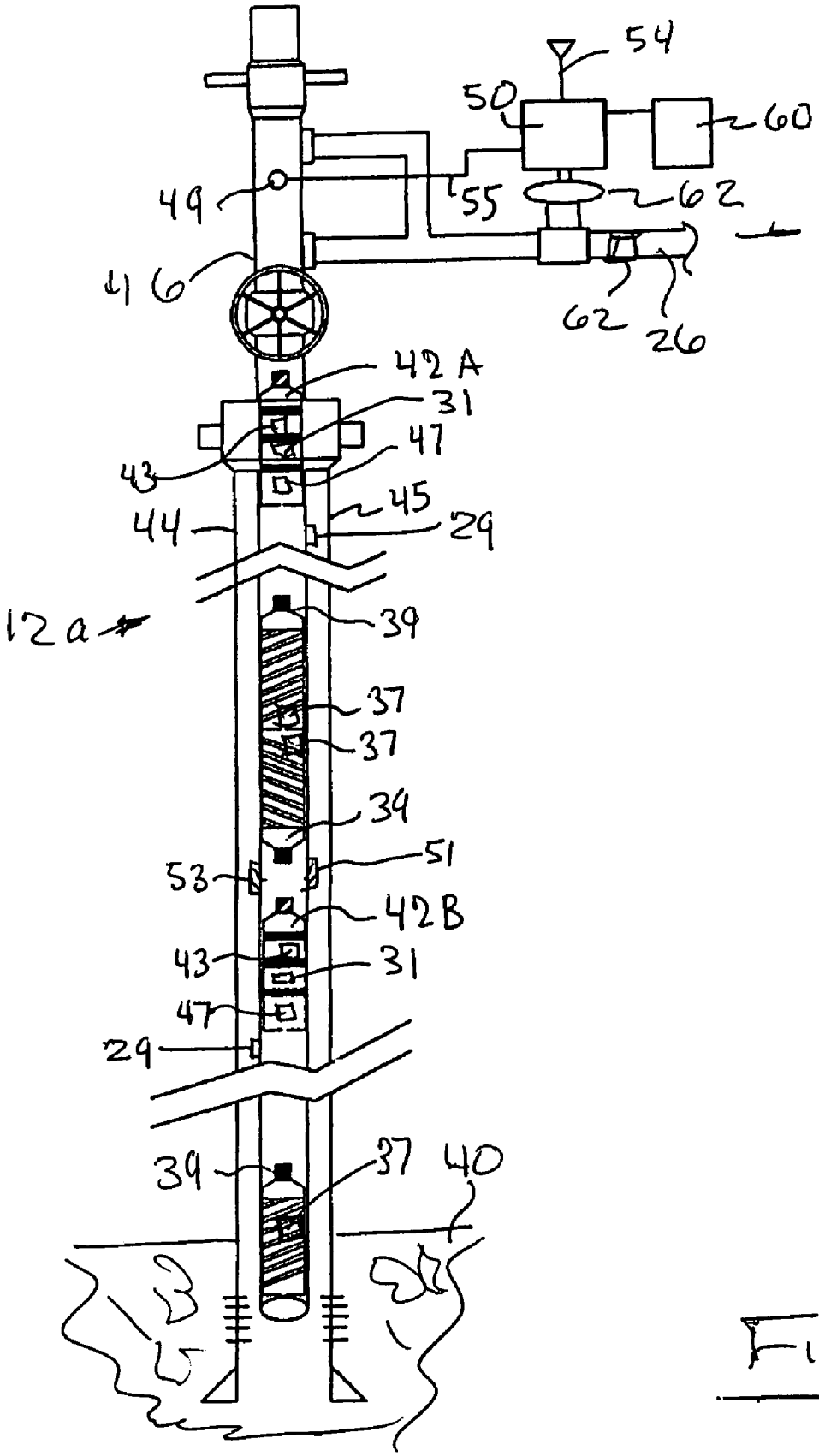
FIG. 3 is a side elevational view of an individual well showing the components thereof, particularly with more than one plunger therewith.

Each production well 12*a*-12*n* of the collection field is drilled into the earth's oil/gas-production formation 40, as represented in FIG. 2, from which the gas and liquid is retrieved. Each production well 12*a*-12*n* preferably has in one preferred embodiment thereof, a single vertically displaceable plunger 42 arranged within its vertically disposed well tubing 44. A spring cup assembly 39 is preferably arranged at the bottom of the well 12*a* to cushion the plunger's 42 fall. The spring cup assembly 39 preferably includes a signal generator 37 therein, to provide a signal, acoustic and/or electronic, to wellhead sensors 49 at the local or master control units 50 and 52 respectively, that the plunger 42 is at the bottom or touched a particular cup assembly 39, of a particular well. The plunger 42 is pressurizably pushed to the top or wellhead 46 of the well tubing 44, whereupon the sensors 49 at the well top, lubricator or head 46 of each particular well 12*a*-12*n* may analyze the pressure, flow rate, viscosity, temperature and various conditions of the gas and liquid within that well. The wellhead 46 may have a plunger grasp-mechanism, not shown for clarity, to seize a plunger 42 when necessary, for servicing or replacing that plunger 42. Such a plunger 42 may also have specific sensors and for example, rf, acoustic and/or light transmitters 43 therein, to permit further data and signals to be wirelessly sent to its particular wellhead 46 with its own individual signal receiving/transmitting/processing control unit 50 thereon or to the "field" master control unit 52. Each plunger 42 may also have a signal generator 47 thereon, such as for example, an acoustic noise, rf signal generator or optical generator, which is actuated automatically when the plunger 42 strikes a spring cup 39, or is near the bottom "plunger-stop" location of the tubing 44. Such a plunger 42 may also be "sensed" when it communicably travels past any of a plurality of location-point detectors 51 at a mid point or any other point of the well's tubing 44, such as for example, a female-female coupler 53 which connects adjacent sections of tubing 44 together, as represented in FIGS. 2 and 3. Such a coupler 53 may have an electromagnet field therewith to generate a particular signal in a passing plunger 42 which sends its generated signal to a received-signal sensor 49, within the wellhead 46. Such a coupler 53 may also be located anywhere about the tubing 44, to pickup such plunger mid-point, or at any point and/or bottom-indicating signals and transmit that signal preferably to the local well head control unit 50, (or directly to the master controller 52), for factoring into the well's operating-time decision, so as to minimize the length of time any particular well stays closed or inoperable. Such plunger locations' signals may preferably be an acoustic signal, for example, a bell, noise alarm, or the like picked up by the acoustic portion of the sensor 49 for reporting to the local (well head) control unit 50, or master control unit 52 if this particular well has no local control unit other than for example, a acoustic sensor 49.

A further preferred embodiment of the plunger 42, contemplates a magnet or an electrically (battery) powered induction coil 31 therein which effects the generation of a signal within spaced apart signal pickup transmitters 29 disposed along the length of the tubing 44 of the well 12*a*, as represented in FIGS. 2 and 3. The spaced apart transmitters 29 on the tubing 44 then become the signal generators for transmission of data to the local and/or master control units 50 and 52.

A still further preferred embodiment of the plunger 42 is represented in FIG. 3, which shows a first or upper plunger 42A and a second or lower plunger 42B each preferably having the above-described signal generating and sensing means therewith, those plungers 42A and 42B each moving respectively in their respective upper and lower portions of the tubing 44 of the well 12*a*. Each plunger 42A and 42B preferably separately report through their respective adjacent signal transmitters/receivers 31, 43 and 47, 53 and 29, their respective "well portion" conditions.

The production field/facility or battery 14, has the master controller 52 thereat, as represented in FIG. 1. Each individual control unit 50, which preferably is located at each particular well 12*a*-12*n* is in electronic communication with the master control 52 at the battery or production facility 14 via a landline, internet, or RF or wireless communication, such as for example, a Zigbee network arrangement or communication connection 54 therebetween. The master control unit 52 at the production facility, or battery 14, continuously monitors the field of wells 12*a*-12*n* and their respective individual control units 50, or monitors each well's flow rate, pressure etc. directly, if any/that particular well does not have its own individual control unit 50. When a particular plunger 42 has triggered certain preferred "identifier" signals through sensors 49 within its particular wellhead 46 in communication with the particular control unit 50 thereat, the master control 52 at the battery 14 may command that particular individual control unit 50 to initiate production of gas and liquid from that particular well 12*a* or 12*n* through its pipelines 56 and 24 to the separator 16.

In the case of a well without a plunger 42 therewith, the particular individual control unit 50 may sense pressure, and/or flow rate and/or well operating-time-history directly measured by the sensor 49 at the wellhead 46, for determining continuing operating control and flow maintenance.

The sensor 49 at the wellhead 46, connected to the well's tubing 44 and casing 45 respectively, is preferably connected wirelessly or thru a wired connection 55, to the well's control unit 50, and then thru connection 54, (wirelessly or by wire) to the master controller 52. The master controller 52 has a virtual wellhead controller set up within it for each of the individual wells 12*a*-12*n*. The virtual controller in the master controller 52 actually keeps all the time values for the individual well controller 50 and also monitors pressure in the casing 45 and tubing 44 for each well 12*a*-12*n*, whether supported by a plunger 42 therein or not. These are the primary factors which determine whether a well is ready to flow or not. At this juncture, the plunger 42 is the only mechanical interface between the gas and liquid phases of fluid in the well and is utilized to prevent fluid fall back in the tubing 44 when the well is flowing. The master control unit 52 however, monitors the supply of gas and liquid as the gas itself is fed through the meter run 22 from the particular currently producing well 12*a* or 12*n*.

When a next available priority well 12*n* or 12*a* is signaling the master controller 52 from its own particular individual control unit 50, the master control 52 will signal that next available well 12*n* or 12*a* to begin production once the currently producing well's plunger 42 has arrived or it's respective valve has closed depending upon the relative priority of one to the other. The constant monitoring by the master control unit 52 of all of the wells 12*a*-12*n* within its particular field thus monitors and optimizes each well's output to the separator 16, as well as determines which well 12*a*-12*n* is producing what quantity of gas. This is significant in certain situations, because each particular well may be owned by a different entity. A mechanical override may be permitted by the operator in case of a special field condition, as for example, to permit a weak well to flow occasionally to "hold a lease" or to insure that such a slow well doesn't become sealed off or develop other downhole and/or surface problems.

Each particular well may be controlled by its own individual unit controller 50 and being powered by, for example, a solar panel 60 and motor valves 62, which are ultimately controlled by the master control unit 52 at the battery 14, as represented in FIG. 2. The controller 50 activates the motor valves 62 and causes it/them to open or close as it receives a signal to do so from the master controller 52. Any particular well may be closed for time, to permit pressure to build up therein, wherein that wellhead 46 will be open to flow, bringing that plunger 42 and its liquid load to the surface. During such a flow, the particular well may have a high rate of output because of its optimized procedures. By controlling each individual well's flow into the separator 16, the volume of the gas and liquid may be easily handled, instead of being overwhelmed if all wells were to flow at their own particular flow rate. A strong well and a weak well, if allowed to flow simultaneously, would be detrimental to the weak well, where that weaker well would load up with fluid because its plunger 42 could not make it to the surface to deliver its liquid load.

Such plungers 42 themselves, may have sensors therein, to provide an rf, sonic, microphone (acoustic), certain fluid penetratable light or wireless data feed to corresponding sensor(s) in/at the local control units 50 at each particular well 12*a*-12*n*. Such communication between the plunger 42 (or 42A and 42B) and the individual control unit 50 would preferably be via radio (rf) or acoustic or like communication therebetween. Such control unit 50 at each wellhead is preferably responsible for turning the well on and off, and reporting the pressure in the casing 45 and the tubing 44 of the well 12*a*-12*n* to the master controller 52. The control unit 50 may be programmed to slow down speed of its plunger 42 by controlling flow rate and pressure within the wellhead 46, so as to prevent any damage to the well 12*a* by an excessively fast plunger 42 therein.

When a well 12*a*-12*n* is ready to come online and begin producing, either inclusively or exclusively as a function of time, flow rate, well history and/or a function of pressure, the master controller 52 at the production facility 14 would permit it to do so, via a return signal through communication link 54. Once the local control unit 50 is turned on at a particular well 12*a*-12*n*, that well would continue to produce until its particular plunger 42 rose to the surface. Once the plunger 42 surfaces, the controller 50 of that unit 12*a*-12*n* goes into a "after flow" cycle. Once in this after flow cycle, any well 12*a*-12*n* of higher priority than the flowing well in the "ready-to-open" state would be allowed to come on and override the remaining flow of this particular diminishing weaker well. The master controller 52 at the separator 16 in the production facility 14 would signal the weaker well to close and signal the stronger well to come online.

The master controller 52 at the separator 16 therefore works at optimizing the throughput of the separator 16 and its fed meter run 22. Such optimization may preferably be based upon the data output of the wireless plungers 42 reporting in each of the system's wells in conjunction with factors reported from all the wells in the system.

Each well's production in the producing field is logged against its actual flow, and the priority is established. The highest producing well of the collection 12*a*-12*n* would normally have the highest priority, unless overridden manually. The master control unit 52 at the production facility or battery 14 is programmed to assess what the priority should be according to the production on an operator programmed interval from typically every several hours, to perhaps, once a week. This permits the priority of the wells 12*a*-12*n* to change as producing characteristics of individual wells have changed. This also permits further optimization of individual wells by their respective local control units 50. The master control 52 at the production facility 14 constantly calculates and analyzes production volume from each particular well. If the flow rate of a particular producing well falls below a calculated average and another well is ready to open, then the currently producing well will be signaled to close and the new well will be signaled to be open. If there are no wells ready to be open, the currently producing well will be permitted to flow even though it is below the average for the production facility, until its after-flow time expires, its close pressure parameter is reached, or another well is ready to open.

Figure 4:
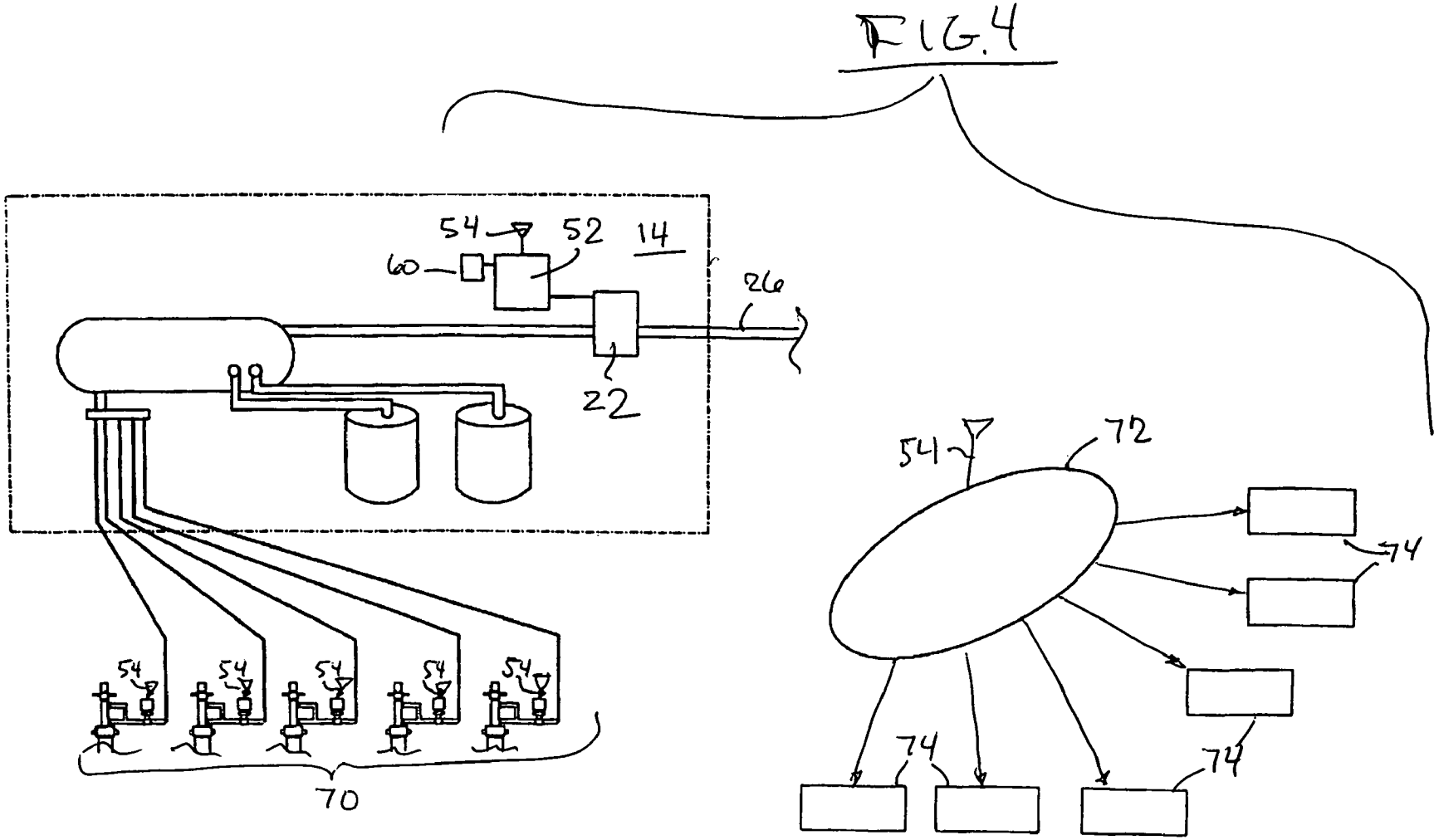
FIG. 4 is a schematic representation of the system from the wells to the master controller and ultimately to the owners of the particular wells or well.

FIG. 4 schematically represents the well field 70, the production facility (master control unit) 14, and the members 74 of the system which receive reports and system conditions over an internet reporting arrangement 72.

The invention claimed is:

1. A method of optimizing fluid (gas/oil) throughput of a battery complex to monitor and control the flow of an individual well in a collective field of wells at any particular instance in time and to allocate production of a specific well, comprising the steps of:

providing a master control unit within said battery complex;

placing an individual control unit in communication with at least one of said individual wells in said field of wells;

arranging a communication network between each of said at least one of said individual control units in said field and said master control unit in said battery complex;

arranging at least a first or upper plunger and a second or lower plunger in at least one of the individual wells;

sending well condition signals from at least the first or the second plunger in the individual well to said individual control unit in communication with said individual well;

reporting each individual well's production factors to said master control unit; and sending a control signal to each individual well to control its production based upon the monitoring of the collective signals of said individual control units and individual well's signals received by said master control unit from said field of individual wells.

2. The method as recited in claim 1, including:

selecting one of said wells from said collection of wells, based upon its monitored signal, to begin production.

3. The method as recited in claim 1, including:

providing data on output and selected factors of each well in said field by said master control unit.

4. The method as recited in claim 1, including:

shutting down production of a first well once said master control unit has determined a superior production may be generated by another well.

5. The method as recited in claim 4, including:

initiating production from said another well by a signal sent thereto from said master control unit, after said first well has been shut down by an instruction signaled from said master control unit to said first well.

6. The method as recited in claim 1, including:

monitoring the location of said first and second plungers in said well containing said plungers through a signal sent from said well's individual control unit to said master control unit.

7. The method as recited in claim 6, including:

controlling movement of said plungers in said well containing said plungers by controlling any output of said individual well.

8. The method as recited in claim 6, including:

tracking said second or lower plunger when said second or lower plunger is at the bottom of a well to factor bottom-location time into well-control functions by said individual control unit.

9. The method as recited in claim 6, including:

tracking either said first or second plunger when said plunger is at any point in the tubing of a well to factor location time into well-control functions by said individual control unit.

10. The method as recited in claim 1, including:

sending signals received from either said first or second plunger in an individual well by said individual control unit thereat, to said master control unit in said battery complex for monitoring and control of said well's production.

11. A method of optimizing fluid (gas/oil) throughput of a battery complex to monitor and control the flow of an individual well in a field of wells at any particular instance in time and to allocate production of a specific well, comprising the steps of:

monitoring continuously a plurality of individual wellhead control units in a well field, wherein at least one of said individual wells in said field has at least a first or upper condition monitoring plunger and a second or lower condition monitoring plunger therein;

evaluating input data received from each of said individual wellhead control units by a master control unit;

selecting a priority well for a production run in a series of production runs by said master control unit; and recording volume flow of each successive well's production by said master control unit.

12. A fluid (gas/oil) battery complex to monitor and control the flow of an individual well in a field of wells at any particular instance in time and to allocate production of a specific well, comprising:

a plurality of gas wells in a production field, with at least one of said individual wells in said field having at least a first or upper plunger and a second or lower plunger reporting upon the well's condition;

a local control unit for each of said wells in said field;

a master control unit in said battery complex in communication with said local control unit at each of said wells in said field to monitor, control and report upon each individual well's gas production; and a separator to separate gas from other fluids produced from said wells.

13. The fluid battery complex as recited in claim 12, wherein at least one of said p1ungers has an alarm mechanism therewith to send an alert signal to said well's individual control unit that said plunger is at a specific location of said well.

14. The fluid battery complex as recited in claim 13, wherein said alarm mechanism on said plunger is an acoustic alarm mechanism.

15. The fluid battery complex as recited in claim 13, wherein said alarm mechanism comprises different acoustic signals at different locations within said well.

16. The fluid battery complex as recited in claim 13, wherein said well's individual control unit comprises an acoustic sensor arranged at a wellhead of said well in said field so as to pick up and report upon said plunger's real-time location.

17. The fluid battery complex as recited in claim 13, wherein said individual control unit at the wellhead is arranged to monitor and control velocity of at least one of said plungers in said well through wellhead controls thereon.

18. The fluid battery complex as recited in claim 12, wherein at least one of said plungers has a pressure and fluid condition sensors therein to signal said individual control unit on said wellhead relative to said well's production characteristics.

19. An fluid (gas/oil) battery complex to monitor and control the flow of an individual well in a field of wells at any particular instance in time and to allocate production of a specific well, comprising:

a plurality of gas wells in a production field;

a local control unit for each of said wells in said field;

a master control unit in said battery complex in communication with said local control unit at each of said wells in said field to monitor, control and report upon each individual well's gas production;

a separator to separate gas from other fluids produced from said wells;

a wireless plunger signal generating arrangement in each of said wells to provide individual well data to said local control unit from at least one of at least two plungers, for that particular well, wherein said wireless plunger reports data on its own well, and said master control unit accumulates data from all of said well's wireless plungers to provide instantaneous optimization of a fields output and said wells identifying data, said plunger having an alarm mechanism therewith to send an alert signal to said well's individual control unit that said plunger is at a specific location of said well, wherein said alarm mechanism on said at least one of said at least two plungers is an acoustic alarm mechanism, and wherein said alarm mechanism comprises different acoustic signals at different locations within said well.

20. A method of optimizing fluid (gas/oil) throughput of a battery complex to monitor and control the flow of an individual well in a field of wells at any particular instance in time and to allocate production of a specific well, wherein at least one of said individual wells in said field has at least at least a first or upper plunger and a second or lower plunger, the method comprising the steps of:

monitoring continuously a plurality of acoustic signal-receiving wellhead control units in a well field;

evaluating acoustically generated input data received from each of said acoustic signal-receiving wellhead control units by a master control unit;

selecting a priority well for a production run in a series of production runs by said master control unit; and recording volume flow of each successive well's production including any well with said first and second plunger, by said master control unit.

21. The method as recited in claim 20, including:

arranging an acoustic signal generating means in a bottom plunger-stop location of said well.

22. The method as recited in claim 20, including:

arranging a signal generating means in a plurality of spaced apart locations along the depth of said wells.

23. A fluid (gas/oil) battery complex to monitor and control the flow of an individual well in a field of wells at any particular instance in time and to allocate production of a specific well, comprising:

a plurality of gas wells in a production field;

a local control unit for each of said wells in said field;

a first upper and a second or lower movable plunger arranged within tubing in at least one of said wells whose movement is arranged to generate a signal regarding said plungers location in said tubing at a particular time, to its respective local control unit;

a master control unit in said battery complex in communication with said local control unit at each of said wells in said field to monitor one or both of said plungers, and to thereby control and report upon each individual well's gas production; and a separator to separate gas from other fluids produced from said wells.

24. The fluid (gas/oil) battery complex as recited in claim 23, wherein said signal generated by movement of said at least one of said plungers is an acoustic signal.

25. The fluid (gas/oil) battery complex as recited in claim 23, wherein said signal generated by movement of said at least one of said plungers is an electromagnetic signal.

26. The fluid (gas/oil) battery complex as recited in claim 23, wherein said signal generated by movement of said at least one of said plungers is transmitted to said local control unit by a signal receiver/transmitter arranged on said tubing.

27. A method of optimizing fluid (gas/oil) throughput of a battery complex to monitor and control the flow of an individual well in a field of wells at any particular instance in time and to allocate production of a specific well, comprising the steps of:

monitoring continuously a plurality of signal-receiving wellhead control units in a well field, wherein said well head control unit of at least one specific well in said field receives a signal from at least one of at least a first or upper plunger or a second or lower plunger in the at least one well in the well field;

evaluating generated input data received from each of said signal-receiving wellhead control units by a master control unit;

selecting a priority well for a production run in a series of production runs by said master control unit; and recording volume flow of each successive well's production by said master control unit.

28. The method as recited in claim 27, including:

moving at least one of said plungers through said specific well's tubing, so as to generate a well-condition signal by virtue of said plunger's movement in said tubing, relative to a signal receiver/transmitter on said well's tubing.

29. The method as recited in claim 28, wherein said well-condition signal is an acoustic signal.

30. The method as recited in claim 28, wherein said well-condition signal is an electromagnetic signal.

31. The method as recited in claim 30, wherein said tubing has an electromagnetic field generator thereon.

32. The method as recited in claim 28, wherein said plunger arrangement has an electromagnetic field generator therein.

33. The method as recited in claim 27, wherein said upper plunger and said lower plunger each emit well-condition reports on respective upper and lower portions of said well.

* * * * *